United States Patent [19]

Krehbiel et al.

[11] Patent Number: 5,017,162

[45] Date of Patent: May 21, 1991

[54] ELECTRICAL CONNECTOR WITH TERMINAL ALIGNMENT AND POSITION ASSURANCE COMPONENT

[75] Inventors: Fred L. Krehbiel, Chicago; Bill B. Wilson, Montgomery; Stephen A. Colleran, Lisle, all of Ill.

[73] Assignee: Molex Incorporated, Lisle, Ill.

[21] Appl. No.: 506,315

[22] Filed: Apr. 9, 1990

[51] Int. Cl.[5] ..... H01R 13/514

[52] U.S. Cl. ..... 439/752; 439/695; 439/599; 439/744

[58] Field of Search ..... 439/271, 272, 273, 586, 439/587, 595, 596, 599, 600, 597, 598, 731, 752, 677, 680, 695, 701, 744

[56] References Cited

U.S. PATENT DOCUMENTS

| | | | |
|---|---|---|---|
| 4,637,674 | 1/1987 | Kobler | 439/271 |
| 4,900,271 | 2/1990 | Colleran et al. | 439/595 |
| 4,934,963 | 6/1990 | Gardner et al. | 439/752 |

*Primary Examiner*—David L. Pirlot

*Attorney, Agent, or Firm*—Louis A. Hecht; Stephen Z. Weiss; Charles S. Cohen

[57] ABSTRACT

A sealed electrical connector assembly is provided for wire-to-wire electrical connections. The assembly includes a pair of mateable electrical connectors each of which includes a plurality of terminal receiving cavities extending therethrough. Each terminal receiving cavity preferably includes a static locking projection and a dynamic terminal positioning beam which deflects during insertion of the corresponding terminal and which resiliently returns to an undeflected condition for locking the terminal in the housing after complete insertion. A TPA component is mounted to the rear of each housing prior to insertion of the terminal. The TPA component includes terminal receiving apertures which function to rotationally align each terminal for efficient full seating in the corresponding terminal receiving cavity. Positive assurance of full terminal seating is achieved by advancing the TPA component from a first position into a second locked position.

15 Claims, 3 Drawing Sheets

ELECTRICAL CONNECTOR WITH TERMINAL ALIGNMENT AND POSITION ASSURANCE COMPONENT

BACKGROUND OF THE INVENTION

Electrical connectors for automobiles are subjected to broad ranges of temperature, moisture, vibrations, and occasional direct contact. As a result, electrical connectors intended for automotive applications should provide an environmentally sealable housing that can lockingly receive and protect electrically conductive terminals therein, and that can lockingly engage a mating connector. Automobile manufacturers also generally require terminal position assurance (TPA) means to positively assure that the electrically conductive terminals are properly seated in the housing of the connector. It also is desirable to provide an electrical connector that is easy to assemble and easy to mate.

The prior art includes many electrical connectors that provide some assurance of positive locked engagement of the terminals therein and that lockingly mate with another connector. The prior art further includes various environmental sealing means for electrical connectors.

A typical prior art connector intended for automotive applications is shown in U.S. Pat. No. 4,557,542 which issued to Coller et al. on Dec. 10, 1985. The electrical connector shown in U.S. Pat. No. 4,557,542 includes a housing with pairs of terminal receiving cavities extending therethrough. The terminal receiving cavities in each pair are separated by a pair of forwardly projecting deflectable latches for engaging terminals inserted therein. The terminals are inserted into the respective cavities from the rear of the housing, and cause the latches to initially deflect and then resiliently return to engage the terminal. The connector shown in U.S. Pat. No. 4,557,542 further includes a TPA component which is slid into the forward end of the housing. If the terminals are properly seated and locked, the TPA component will advance between the forwardly projecting latches in each pair. If any terminal is not properly seated, the TPA component will not fully advance into the forward end of the electrical connector housing. The electrical connector shown in U.S. Pat. No. 4,557,542 does not provide means for aligning terminals with interior forwardly disposed portions of the terminal receiving cavities. Thus, terminal insertion can be difficult and the small terminals can be damaged. Furthermore, the housing typically will be manufactured in one location and shipped to another location where the terminated leads are inserted. The provision of an entirely separate TPA component which also must be shipped to the location where the terminals are inserted can create inventory control problems. Additionally, the deflectable terminal locking means shown in U.S. Pat. No. 4,557,542 may be weaker and permit greater terminal movement than a comparable terminal locking means on a nondeflectable structure. Still further, the forwardly disposed TPA component can interfere with seals in a pair of mating connectors.

Another such electrical connector is shown in U.S. Pat. No. 4,714,437 which issued to Dyki on Dec. 22, 1987. The connector shown in U.S. Pat. No. 4,714,437 also includes pairs of terminal receiving cavities in an electrical connector housing. The wall between each pair of terminal receiving cavities is defined in part by a pair of forwardly projecting deflectable levers. The latches in the connector of U.S. Pat. No. 4,714,437 are not disposed on the deflectable levers, but rather are static and are rigidly disposed on exterior walls of the electrical connector housing. As noted above, this may provide additional locking strength and positively position the terminals. However, the connector shown in U.S. Pat. No. 4,714,437 suffers similar deficiencies to the previously described connector in that the TPA component is forwardly mounted after insertion of the terminals, and therefore can contribute to inventory control problems and can interfere with seals on mating structures. Furthermore, it may be difficult to properly align the terminals during insertion into the housing since the area of minimum cross section in the terminal receiving cavity is disposed well forwardly of the rear entry to the housing.

Still another similar electrical connector is shown in U.S. Pat. No. 4,749,372 which issued to Betsui on June 7, 1988. The connector of U.S. Pat. No. 4,749,372 also includes a pair of forwardly projecting latches disposed intermediate a pair of terminal receiving cavities. The TPA component is insertable into the forward end of the connector, thereby providing at least some of the deficiencies explained above. However, the exteriorly disposed portion of the TPA component is severable from portions thereof inserted into the housing. The connector shown in U.S. Pat. No. 4,749,372 provides no means for aligning the terminals for insertion into the housing.

A more efficient wire-to-wire electrical connector for automotive applications is shown in U.S. Pat. No. 4,776,813 which is issued to Wilson et al. on Oct. 11, 1988 and which is assigned to the assignee of the subject invention. The connector of U.S. Pat. No. 4,776,813 includes an electrical connector housing with a TPA component that is mounted to the rear of the housing. Thus, the TPA component does not interfere with seals between the electrical connector to which it is mounted and a mating connector. Additionally, in the embodiment depicted in U.S. Pat. No. 4,776,813, the TPA component is urged against a seal disposed in the rearward end of the electrical connector housing to contribute to sealing the rear of the connector. The connector shown in U.S. Pat. No. 4,776,813 has proved to be very successful. However, it is desirable to provide even further improvements to such electrical connectors. More particularly, it is now considered desirable to provide an electrical connector with even stronger locking of the terminals therein and wherein alignment of the terminals to terminal receiving cavities in the housing is achieved to facilitate assembly of the electrical connector. It is also now considered to be desirable to provide greater assurance that the seals on the mating end of the connector do not interfere with locking structure on the connectors.

Other electrical connectors with terminal locking means and/or with terminal position assurance means are shown in: U.S. Pat. No. 4,826,452 which issued to Sian et al. on May 2, 1989; U.S. Pat. No. 4,810,205 which issued to O'Grady on Mar. 7, 1989; U.S. Pat. No. 4,784,617 which issued to Oda on Nov. 15, 1988; and U.S. Pat. No. 4,711,508 which issued to Sueyoshi on Dec. 8, 1987. The connectors in these references, however, do not provide for the most efficient terminal locking, terminal alignment during assembly and sealing during mating.

In view of the above, it is an object of the subject invention to provide an improved electrical connector for automotive applications.

It is another object of the subject invention to provide an electrical connector which enables efficient alignment of the terminals for facilitating assembly of the connector.

It is an additional object of the subject invention to provide an electrical connector with a TPA component which contributes to sealing and to terminal alignment.

Still a further object of the subject invention is to provide an electrical connector having efficient sealing means at the mating end thereof.

SUMMARY OF THE INVENTION

The subject invention is directed to a sealed electrical connector assembly for wire-to-wire electrical connections. The electrical connector assembly comprises a pair of mateable electrical connectors. Each connector in the pair comprises a molded nonconductive housing having a forward mating end, a rearward end, and a plurality of terminal receiving cavities extending therebetween. The mating ends may be configured for polarized mating with one another, and may include means for locking and sealing the connectors in their mated condition. The sealing means may be disposed to ensure efficient mating without the sealing means interfering with either the terminals or the means for locking the terminals in a mated condition.

Each terminal receiving cavity may further include terminal positioning means and terminal locking means. The terminal positioning means of each terminal receiving cavity may be defined by a rearwardly projecting deflectable terminal positioning beam. The locking means of each terminal receiving cavity may be defined by a ramped locking projection. In a preferred embodiment, as explained further herein, the terminal positioning means are disposed interiorly while the terminal locking means are disposed on an exterior wall. The terminal locking means may define a static ramped locking projection on an exterior wall of the housing for providing superior resistance to pullout forces and ensuring accurate positioning of the terminals in the housing. The ramped construction of the locking means will cause the respective terminals to ride inwardly over the ramp and cause deflection of the terminal positioning means. However, upon complete insertion of the terminal, a locking aperture therein will be engaged over the ramped locking projection enabling the terminal positioning means to resiliently return to its undeflected condition and urging the terminal into locked engagement with the static locking projection.

The terminal positioning means may define beams which extend rearwardly in generally parallel spaced relationship to one another with the space therebetween permitting insertion of a TPA wedge. In particular, the TPA wedge will be fully insertable only in conditions where all terminals have been properly seated and locked, such that the respective terminal positioning beams will have resiliently returned to their undeflected condition.

The rearward end of each electrical connector housing in the assembly may comprise means for receiving an end seal and means for lockingly engaging a TPA component in alternate first and second positions. With this construction, a housing subassembly comprising the housing, seals and the TPA component mounted to the housing can be shipped from the manufacturing and preassembly facility to another location at which wires are terminated and/or inserted into the housing subassembly to complete the electrical connector.

The TPA component comprises terminal receiving apertures aligned respectively with the terminal receiving cavities of the housing. Each aperture of the TPA component may be configured to align the terminal for proper insertion into the terminal receiving cavity of the electrical connector housing. Thus, even though the terminal receiving cavity is disposed intermediate the opposed ends of the housing, proper alignment is assured by the rearwardly disposed TPA component of the subassembly.

In use, the terminals are inserted through the terminal receiving apertures in the TPA component and forwardly into the terminal receiving cavities of the housing. Upon sufficient insertion, the locking apertures of the terminals will lockingly engage with the ramped locking projection of the associated terminal receiving cavity. This locking of the terminal in the housing generally will provide an audible or tactile indication of full seating of the terminal. After the terminals have been fully seated, the TPA component is urged forwardly into its final locked position on the rear end of the housing. An inability to fully advance the TPA component is indicative of at least one terminal not being properly seated and locked in the housing.

DETAILED DESCRIPTION OF THE PREFERRED EMBODIMENT

Figure 1:
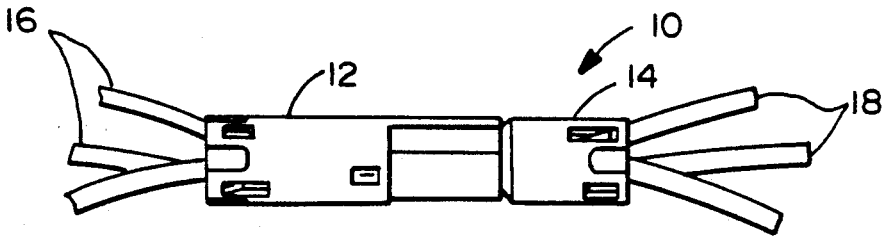
FIG. 1 is a side elevational view of a mated pair of electrical connectors in accordance with the subject invention.

The electrical connector assembly of the subject invention is identified generally by the numeral 10 in FIG. 1. The assembly 10 comprises a male connector 12 and a female connector 14 which are lockingly engageable in sealed electrical connection with one another. The electrical connector assembly 10 is intended for wire-to-wire electrical connections with the male connector 12 receiving a plurality of terminated wire leads 16, and with the female connector 14 receiving a corresponding plurality of terminated wire leads 18.

Figure 2:
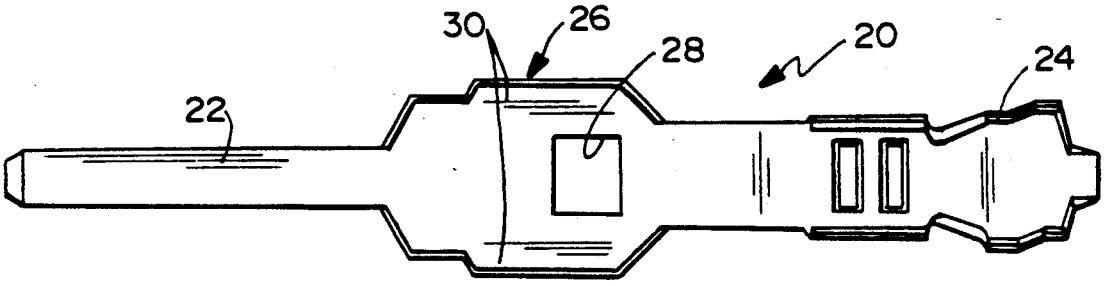
FIG. 2 is a top plan view of a blade terminal for use in an electrical connector in accordance with the subject invention.

The terminal mounted to each of the wires 16 in the male connector 12 is shown in FIG. 2 and is identified generally by the numeral 20. The terminal 20 is stamped and formed from a unitary piece of conductive metal such as a brass alloy. The terminal includes a mating end defining a generally planar blade 22 and a wire mounting end 24 defining a crimpable section for crimped electrical connection to the conductors in the wire 16.

The intermediate portion 26 of the terminal 20 is generally planar and is characterized by a locking aperture 28 for lockingly engaging a ramped locking projection within the housing of the connector 12, as explained further herein. The intermediate section 26 of the terminal 20 further includes a pair of terminal alignment wings 30 extending from opposite sides thereof in generally coplanar relationship to one another. The alignment wings 30 define the maximum cross-sectional dimension of the terminal 20 and will ensure proper alignment of the terminal during insertion into the housing of the connector 12 as explained herein.

The female blade receiving terminal is not depicted herein but will include a known forward mating end for appropriate electrical connection to the blade 22 of the terminal 20 depicted in FIG. 2. The female terminal will further include a rear wire engaging end which may be identical to the rear end 24 of the terminal 20 and an intermediate portion which preferably is identical to the intermediate portion 26 of the terminal 20 depicted in FIG. 2. Thus, despite a differently configured forward mating end, the female terminal will achieve proper alignment and locking with the housing of the electrical connector 14, as explained herein.

The male connector 12 is shown in greater detail in FIGS. 3-6. More particularly, the male connector 12 includes a unitarily molded housing 32 having a forward mating end 34 and a rearward end 36. The housing 32 is generally cylindrical, however, the forward mating end 34 is noncylindrical and nonsymmetrical for achieving proper polarized mating with the female connector 14 as explained further below.

A mating cavity identified generally by the numeral 38 extends rearwardly from the forward end 34 of the housing 32. The cavity 38 is characterized by a major width portion 40 in proximity to the forward end 34 and a minor width portion 42 disposed rearwardly thereof. The cavity 38 terminates at a rear wall 44 adjacent the minor width portion 42 thereof. The housing 32 is further provided with a locking aperture 46 extending therethrough at the major width portion 40 of the cavity 38. The provision of the locking aperture 46 in the major width portion 40 greatly facilitates insertion of the female connector 14 with a seal thereon into the cavity 38 of the housing 32. More particularly, the elastomeric seal on the female connector will not be subject to unintentional engagement with the aperture 46 during insertion as explained further below.

Figure 3:
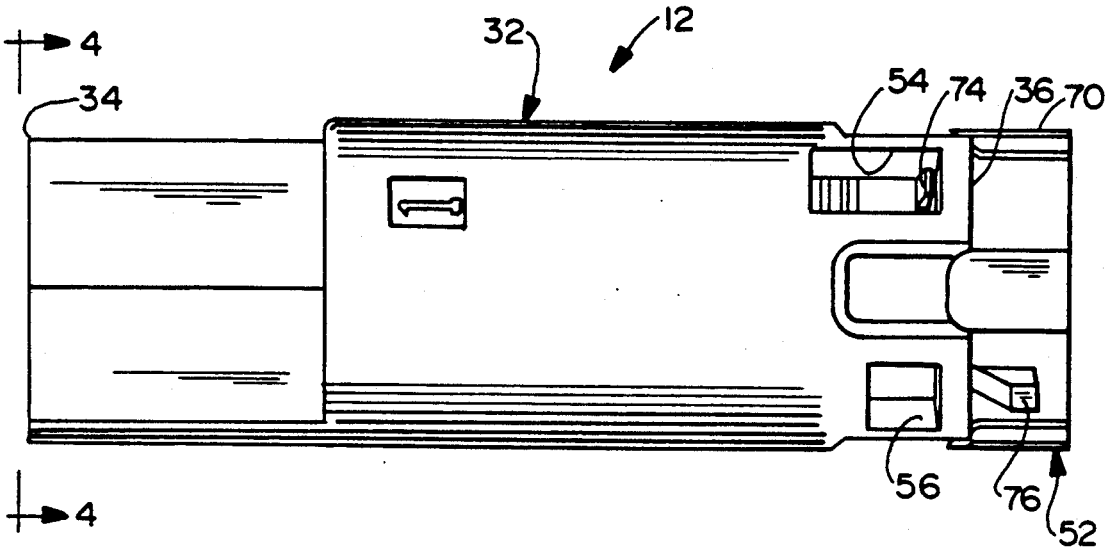
FIG. 3 is a side elevational view of a male connector in accordance with the subject invention.
Figure 4:
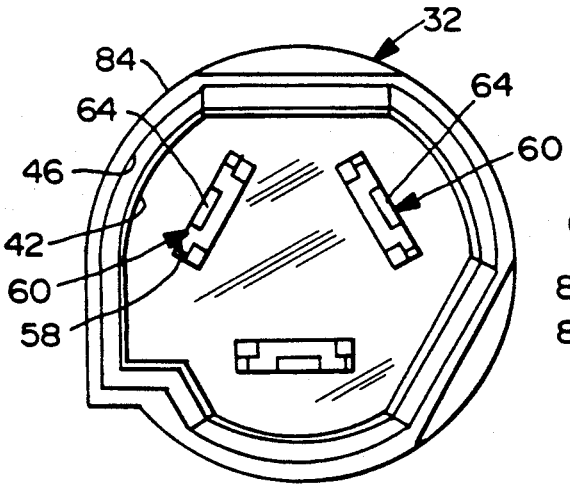
FIG. 4 is a front elevational view of the electrical connector as viewed from the left side of FIG. 3.
Figure 5:
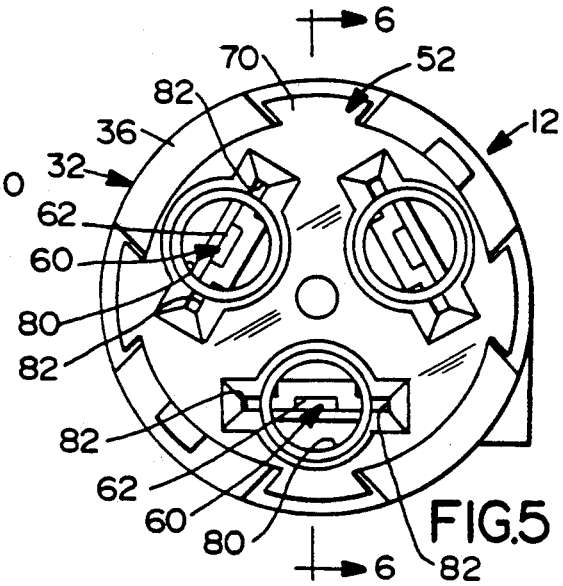
FIG. 5 is a rear elevational view of the electrical connector as viewed from the right side of FIG. 3.
Figure 6:
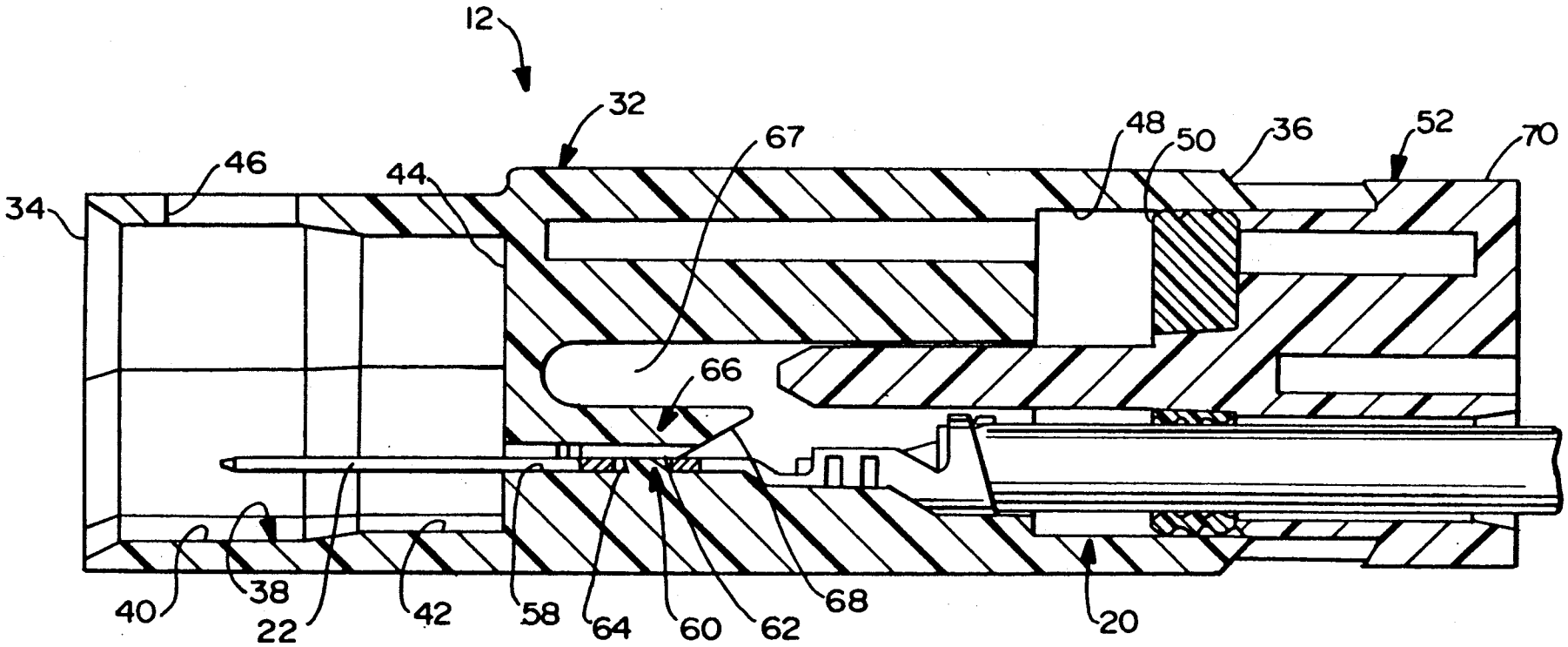
FIG. 6 is a cross-sectional view taken along line 6—6 in FIG. 5.

The housing 32 is further characterized by a rear cavity 48 adjacent the rear end 36 thereof as illustrated most clearly in FIG. 6. The rear cavity 48 is dimensioned to receive an end seal 50 and portions of a TPA component 52 as explained further below. As shown in FIG. 3, the housing 32 further includes a first TPA locking aperture 54 for engaging the TPA component 52 in a first position prior to full assembly and a second TPA locking aperture 56 for lockingly engaging the TPA component 52 in a final locked position.

The housing 32 is further characterized by a plurality of terminal receiving cavities extending between the rear cavity 48 and the forward mating cavity 38. More particularly, the terminal receiving cavities 58 are disposed generally symmetrically about the longitudinal axis of the generally cylindrical housing 32. Each terminal receiving cavity 58 includes a ramped static locking projection 60 on an outer wall thereof. More particularly, the locking projection 60 includes a rearward ramped surface 62 defining an acute angle to the longitudinal axis of the housing 32 and a forward locking surface 64 extending generally orthogonal to the longitudinal axis. The locking projection 60 is dimensioned to be lockingly received within the locking aperture 28 on the terminal 20. Each terminal receiving cavity further includes a resiliently deflectable dynamic terminal positioning beam 66 disposed radially inwardly from the locking projection 60. The terminal positioning beams 66 are disposed symmetrically about the longitudinal axis of the housing 32 such that an axially aligned space 67 exists therebetween for receiving the wedge portion of the TPA component 52 as explained below. Each terminal positioning beam is further characterized by a rearwardly and outwardly facing tapered surface 68 which functions to guide the forward mating end 22 of the terminal 20 into the terminal receiving cavity 58.

The TPA component 52 includes a rearwardly disposed base 70 and a forwardly projecting TPA wedge 72 which is dimensioned to be slidably inserted into the space 67 between the rearwardly cantilevered terminal positioning beams 66. The wedge 72 includes a tapered leading end 74 which facilitates alignment and initial insertion of the TPA component 52 through the seal 50 and into the space 67 in the housing 32. Exterior portions of the base 70 of the TPA component 52 are further characterized by a first latch 74 for engaging the first TPA locking aperture 54 in the housing 32 and a second latch 76 for engaging the second TPA locking aperture 56 in the housing 32. The base 70 is further characterized by polarization projections 78 for ensuring proper angular alignment of the TPA component 52 with the housing 32.

The base 70 of the TPA component 52 further includes a plurality of axially aligned terminal receiving apertures 80 which are dimensioned to receive the terminals 20 and portions of the wires 16 engaged therewith. Each terminal receiving aperture 80 includes a pair of coplanar terminal alignment channels 82 extending outwardly therefrom for receiving the alignment wings 30 of the terminal 20. Thus, the terminal alignment channels 82 ensure proper alignment of the terminal 20 for insertion into the terminal receiving cavity 58 of the housing 32. This initial alignment achieved by the sliding engagement of the alignment wings 30 in the terminal alignment channels 82 of the TPA component 52 further ensure that the locking aperture 28 of the terminal 20 will be aligned for engagement with the locking projection 60 in the terminal receiving cavity 58 of the housing 32.

Figure 7:
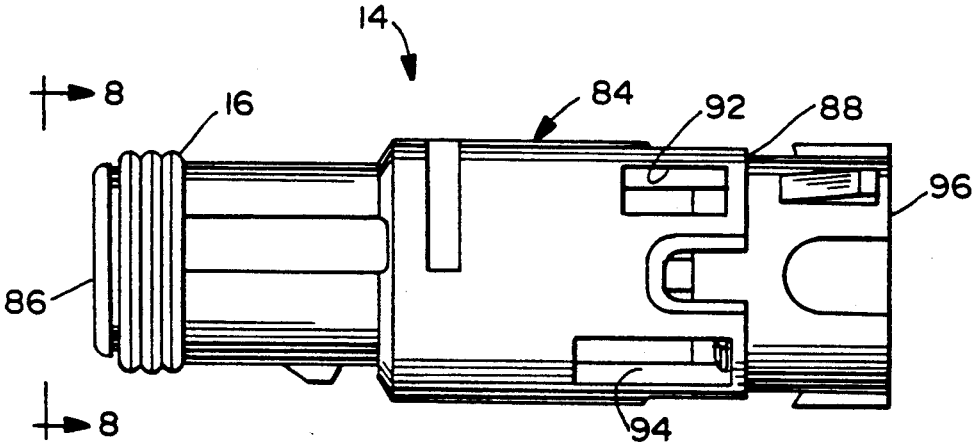
FIG. 7 is a side elevational view of a female connector in accordance with the subject invention.
Figure 8:
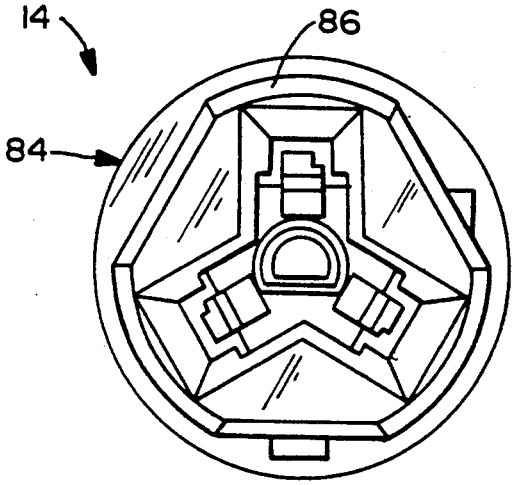
FIG. 8 is a front end elevational view of the female connector as viewed from the left side of FIG. 7.

The female connector 14 is shown in greater detail in FIGS. 7 and 8. The female connector 14 includes a housing 84 having a forward mating end 86 and a rearward end 88. The forward mating end 86 is dimensioned to be slidably inserted into the minor width portion 42 of the mating cavity 38 of the male connector 12. Exterior portions of the housing 84 adjacent the forward mating end 86 are provided with front seals. In view of the tapered entry to the mating aperture 38 of the male connector 12, the seals 90 are not subject to interference with or snagging on the locking aperture 46 on the male connector 12. More particularly, the seals 90 will pass easily through the major width portion 40 of the mating aperture 38 but will sealingly engage the minor width portion 42 of the mating aperture 38.

The housing 84 further includes first and second TPA locking apertures 92 and 94 which preferably are structurally and functionally similar to the locking apertures 54 and 56 on the housing 32. More particularly, the TPA locking apertures 92 and 94 enable mounting of the TPA component 96 in alternate first and second positions thereon. The housing 84 is further characterized by a plurality of terminal receiving cavities (not shown) extending between the forward mating end 86 and the rearward end 88. The terminal receiving cavities preferably include static locking projections and dynamic terminal positioning beams as had been explained with respect to the housing 32.

Returning to FIGS. 3–6, the male connector 12 is initially assembled by first inserting the seal 50 into the rear cavity 48 of the housing 32 and then urging the TPA component 50 into the first locked position where the locking projection 74 thereof engages the first locking aperture 54 of the housing 32. This effectively defines a subassembly which can be shipped from one location to another for final assembly. Final assembly of the connector 12 is achieved after each terminal 20 has been crimped to a corresponding wire 16. More particularly, the terminals 20 are urged through the apertures 80 in the TPA component 52. Proper rotational alignment of each terminal 20 is ensured by the opposed terminal alignment channels 82 which engage and guide the laterally extending terminal alignment wings 30 of each terminal 20. This alignment of each terminal 20 ensures that the mating end 22 will be urged into the associated terminal receiving cavity 58 of the housing 32 in proper rotational alignment.

The initial insertion of the terminal 20 into the terminal receiving cavity 58 will cause the forward mating end 22 of the terminal to ride in a radially inward direction upwardly over the ramped locking projection 60 of the associated terminal receiving cavity 58.

This radially inward movement of the terminal 20 will cause a radially inward deflection of the corresponding terminal positioning beam 66. However, upon sufficient insertion of the terminal 20, the locking aperture 28 thereof will align with the locking projection 60 in the terminal receiving cavity 58. Upon such alignment, the dynamic terminal positioning beam 66 will resiliently return to its undeflected condition and urge the locking aperture 28 of the terminal 20 into secure locking engagement with the locking projection 60.

After each terminal 20 has been fully seated in the housing 32, the TPA component 52 may be advanced forwardly such that the wedge 72 thereof is urged into the axially aligned space 67 intermediate the respective dynamic terminal positioning beams 66. If any of the terminals 20 is not fully seated in the corresponding terminal receiving cavity 58, the inward deflection of the corresponding dynamic terminal positioning beam 66 will prevent advancement of the wedge 72 of the TPA component 52 into the axially aligned space 67 of the housing 32. On the other hand, complete forward movement of the TPA component 52 and locking engagement between the TPA lock 76 and the second TPA locking aperture 56 positively assures complete and accurate seating of each terminal 20. It will be understood that a comparable insertion of terminals into the female connector 14 can be carried out as explained above.

The terminals 12 and 114 can be mated by merely urging the forward mating end 86 of the connector 14 into the mating cavity 38 at the forward mating end 34 of the housing 32 of the connector 12. The initial movement of the forward end 86 into the mating cavity 38 is carried out easily in view of the large width portion 40. In particular, the front seals 90 of the connector 14 will not interfere with or inadvertently snag on the locking aperture 46 in the housing 32 of the connector 12. Upon further mating movement, the front seals 90 will closely engage the minor width portion 42 of the mating aperture 38 and the locking aperture 91 of the housing 84 will engage the aperture 46 of the housing 32. In this fully assembled condition, as shown in FIG. the respective forward mating ends of the connectors 12 and 14 are securely environmentally sealed by the locked engagement of the projection 91 with the aperture 46 and by the close engagement of the front seal 90 in the minor dimension portion 42 of the mating aperture 38. Additionally, the rear end of each connector 12 and 14 is efficiently sealed by the locked engagement of the rear seal 50 between the respective housing 32, 84 and the corresponding TPA component 52, 96.

While the invention has been described with respect to certain preferred embodiments, it is apparent that various changes can be made without departing from the scope of the invention as defined by the appended claims.

I claim:

1. An electrical connector comprising: a housing having a forward mating end, a rear end and a plurality of terminal receiving cavities extending therebetween, each said terminal receiving cavity comprising terminal engaging means inwardly projecting and rigidly disposed in each terminal receiving cavity for lockingly engaging a terminal upon sufficient insertion of said terminal into a selected one of said terminal receiving cavities and a terminal positioning beam, generally located opposite said terminal engaging means forcing said terminal into engagement with said terminal engaging means, having a smooth surface directly opposite said terminal engaging means, being disposed for deflection during insertion of the terminal into the housing and for resilient return to an undeflected condition after complete insertion of the terminal, the terminal positioning beams being disposed in spaced relationship to one another, said connector further comprising a terminal position assurance component having a base selectively lockingly engageable with the rear end of the housing and a wedge member projecting forwardly from said base for slidable insertion intermediate the spaced apart terminal positioning beams when said beams are undeflected, wherein the improvement comprises:

terminal alignment means defined in said terminal position assurance component located in an end of said base allowing for the visual alignment of the terminal in the terminal alignment means prior to the insertion of said terminal into said terminal alignment means thereby also aligning said associated terminal with the terminal engaging means in one of said terminal receiving cavities.

2. An electrical connector as in claim 1 wherein the base of the terminal position assurance component comprises means for lockingly engaging the housing in alternate first and second positions, whereby the terminals are selectively mountable in the housing when the base of the terminal position assurance component is mounted to the housing in the first position, and whereby movement of the base of the terminal position assurance component into the second position on the housing provides assurance of complete insertion of all said terminals into said housing.

3. An electrical connector as in claim 1 wherein the terminal alignment means of the base of the terminal position assurance component comprises at least one channel extending from each terminal receiving aperture for receiving a portion of the associated terminal to ensure selected rotation alignment of the terminal to the terminal receiving cavity of the housing.

4. An electrical connector as in claim 1 further comprising elastomeric seal means disposed intermediate the base of the terminal position assurance component and the terminal receiving cavities of the housing.

5. An electrical connector as in claim 1 wherein the forward mating end of the housing defines a mating cavity, said mating cavity defining a major width portion adjacent the forward mating end of the connector and a minor width portion spaced rearwardly from the major width portion, said minor width portion being dimensioned to receive a seal of a mating connector, portions of said housing defining the major width portion of said mating cavity being characterized by a locking aperture extending therethrough, whereby the seal of the mating connector avoids interference with the locking aperture in the portion of the housing defining the major width portion of the mating cavity.

6. An electrical connector as in claim 1 wherein each said terminal engaging means defines a rearwardly facing ramped wall for urging said terminal toward said terminal positioning beam during insertion of an associated one of said terminals into the corresponding terminal receiving cavity for deflecting the terminal positioning beam during insertion of the terminal.

7. An electrical connector as in claim 3 further comprising a plurality of electrically conductive terminals selectively insertable into corresponding ones of said terminal receiving cavities, each said terminal comprising an alignment wing extending transversely therefrom and defining a maximum width of the terminal, the base of the terminal position assurance component comprising terminal receiving apertures defining widths less than the maximum width of the terminal, the terminal alignment means in the base of the terminal position assurance component defining a channel extending transversely from the terminal receiving aperture therein and dimensioned to receive the terminal alignment wing of an associated one of said terminals, the terminal alignment channel being disposed to ensure selected angular alignment of the terminal with the terminal receiving cavity.

8. An electrical connector as in claim 7 wherein each said terminal comprises a pair of coplanar terminal alignment wings extending transversely from opposite sides thereof, and wherein the terminal alignment means of each terminal receiving aperture comprises a pair of coplanar terminal alignment channels extending transversely from opposite sides of said terminal receiving aperture, whereby each said terminal can be passed through an associated terminal receiving aperture in alternate first and second alignments separated angularly from one another by 180°.

9. An electrical connector comprising a nonconductive housing having a forward mating end, a rear end and a plurality of terminal receiving cavities extending therebetween, each said terminal receiving cavity having a static locking projection inwardly projecting and rigidly disposed therein for lockingly engaging a terminal, each said terminal having a locking aperture formed therethrough for selectively engaging the locking projection upon complete insertion of the terminal into the associate terminal receiving cavity and rearwardly projecting deflectable terminal positioning beams for each said terminal receiving cavity, the terminal positioning beams, having a smooth surface directly opposite said static locking projection, being disposed in generally parallel spaced relationship to one another and in generally opposed relationship to the static locking projection of the associated terminal receiving cavity, whereby the terminal is deflected by the static locking projection during insertion of the terminal into the housing, and whereby upon alignment of the terminal locking aperture with the static locking projection, the terminal positioning beam resiliently returns to its undeflected condition and ensures engagement of the terminal with the associated static locking projection, a terminal position assurance component having a base lockingly engageable with the rear end of the housing and a forwardly projecting wedge for assuring proper seating of the terminals in the housing, wherein the improvement comprises terminal alignment wings extending transversely from the respective terminals and terminal alignment channels formed in the base of the terminal position assurance component located in an end of said component allowing for the visual alignment of the alignment wings of an associated one of said terminals, with the terminal alignment channels prior to the insertion of the terminal alignment wings into said terminal alignment channels, thereby also assuring angular alignment of the terminal with the terminal locking means in the housing.

10. An electrical connector as in claim 9 wherein the wedge of the terminal position assurance component is dimensioned for slidable insertion intermediate the deflectable terminal positioning beams of the housing, whereby an inability to insert the wedge intermediate the terminal positioning beams is indicative of an incompletely inserted terminal.

11. An electrical connector as in claim 9 wherein the terminal position assurance component comprises polarization means for rotationally aligning the terminal position assurance component with the housing.

12. An electrical connector as in claim 9 wherein the base of the terminal position assurance component is lockingly engageable with the housing in alternate first and second positions, the wedge of the terminal position assurance component being spaced from the terminal positioning beams when the base is locked to the housing in the first position, said wedge being advanced intermediate the terminal positioning beams upon movement of the base into the second position on the housing.

13. An electrical connector subassembly for receiving a plurality of terminals and wires engaged therewith each said terminal comprising locking means formed therein for locking engagement with the electrical connector subassembly and at least one alignment wing defining a maximum cross-sectional dimension of said terminal, said electrical connector subassembly comprising:

a molded nonconductive housing having a forward mating end, a rear end and a plurality of terminal receiving cavities extending therebetween, said terminal receiving cavities being dimensioned to receive portions of the terminals therein, each said terminal receiving cavity comprising a rearwardly cantilevered deflectable terminal positioning beam, with the terminal positioning beams of the respective terminal receiving cavities being disposed in spaced relationship to one another, each said terminal receiving cavity further comprising a ramped locking projection inwardly projecting and rigidly disposed therein for urging the terminal into the terminal positioning beam during initial stages of terminal insertion and for lockingly engaging the terminal locking means upon complete insertion of the terminal, said terminal positioning beams having a smooth surface directly opposite said ramped locking projection; and a terminal position assurance component comprising a base engaged with the rear end of the housing in a first position and being selectively movable forwardly in the housing into a second position, the base comprising a plurality of terminal receiving apertures passing therethrough and aligned with the respective terminal receiving cavities of the housing, terminal alignment channels located in an end of said base allowing for the visual alignment of the alignment wings with the terminal alignment channels prior to the insertion of the terminal alignment wings into said terminal alignment channels, said terminal alignment channels also extending from each said terminal receiving aperture of the base for receiving the alignment wing of one of said terminal and rotationally aligning said terminal with the corresponding locking projection of the housing, the terminal position assurance component further comprising a forwardly projecting wedge dimensioned for insertion intermediate the terminal positioning beams upon movement of the base into the second position on the housing, whereby the terminals can be inserted into the subassembly when the base of the terminal position assurance component is in the first position, and whereby the base can be moved into the second position on the housing for urging the wedge of the terminal position assurance component intermediate the terminal positioning beams for assuring complete insertion of the terminals.

14. An electrical connector subassembly as in claim 13 wherein the housing is generally cylindrical and with the terminal position assurance component comprising polarization means for rotationally aligning the base thereof with the housing to ensure alignment of the terminal receiving apertures of the base with the terminal receiving cavities of the housing.

15. An electrical connector subassembly as in claim 14 wherein the terminal receiving cavities of the housing are disposed symmetrically about the longitudinal axis of the cylindrical housing, the terminal positioning beams being disposed in radially inward positions on said housing and with the wedge of the terminal position assurance component being generally axially aligned for insertion intermediate the terminal positioning beams.

* * * * *